US008040334B2

(12) United States Patent
Kim

(10) Patent No.: US 8,040,334 B2
(45) Date of Patent: Oct. 18, 2011

(54) METHOD OF DRIVING DISPLAY DEVICE

(75) Inventor: Heonsu Kim, San Jose, CA (US)

(73) Assignee: 02Micro International Limited, Grand Cayman (KY)

( * ) Notice: Subject to any disclaimer, the term of this patent is extended or adjusted under 35 U.S.C. 154(b) by 738 days.

(21) Appl. No.: 12/004,649

(22) Filed: Dec. 21, 2007

(65) Prior Publication Data

US 2008/0158234 A1 Jul. 3, 2008

Related U.S. Application Data

(60) Provisional application No. 60/877,726, filed on Dec. 29, 2006.

(51) Int. Cl.
*G09G 5/00* (2006.01)

(52) U.S. Cl. ..... 345/204; 345/98; 345/501

(58) Field of Classification Search ..... 345/204, 345/501, 98, 428, 88, 102
See application file for complete search history.

(56) References Cited

U.S. PATENT DOCUMENTS

| | | | | |
|---|---|---|---|---|
| 7,327,329 | B2 | 2/2008 | Kobayashi et al. | |
| 2002/0126083 | A1* | 9/2002 | Cairns et al. | 345/98 |
| 2003/0020699 | A1* | 1/2003 | Nakatani et al. | 345/204 |
| 2003/0128198 | A1* | 7/2003 | Mizuyabu et al. | 345/204 |
| 2005/0068289 | A1* | 3/2005 | Diefenbaugh et al. | 345/102 |
| 2006/0114205 | A1* | 6/2006 | Shen et al. | 345/88 |
| 2006/0146056 | A1* | 7/2006 | Wyatt | 345/501 |
| 2008/0055318 | A1* | 3/2008 | Glen | 345/501 |
| 2008/0100598 | A1* | 5/2008 | Juenger | 345/204 |
| 2009/0225088 | A1* | 9/2009 | Aoki | 345/501 |
| 2009/0251445 | A1* | 10/2009 | Ito et al. | 345/204 |

FOREIGN PATENT DOCUMENTS

| | | | |
|---|---|---|---|
| CN | 1684137 | A | 10/2005 |
| EP | 1560194 | A2 | 8/2005 |

* cited by examiner

*Primary Examiner* — Amare Mengistu
*Assistant Examiner* — Premal Patel

(57) ABSTRACT

A method for driving a display device comprises processing a plurality of sequent frame data by a graphics controller. The graphics controller is capable of optimizing a frame rate and outputting a first plurality of display signals at the frame rate. And then, a timing controller is used to convert the first plurality of display signals into a second plurality of signals at a predetermined refresh rate.

18 Claims, 8 Drawing Sheets

METHOD OF DRIVING DISPLAY DEVICE

CROSS REFERENCE TO PROVISIONAL APPLICATION

This application claims priority to the provisional patent application Ser. No. 60/877,726, entitled "Method of Driving Display Device," with filing date Dec. 29, 2006, and assigned to the assignee of the present invention, which is herein incorporated by reference in its entirety.

TECHNICAL FIELD

The present invention relates to a display device, and in particular, to a system or a method for driving a display device, such as a Liquid Crystal Display (LCD).

BACKGROUND ART

Power saving is a primary goal of electronics designers. For electronic apparatuses, such as laptop computers, power consumption is an essential factor of their performance. A laptop computer's display and graphics card may consume nearly half of the total power consumption of the device. Accordingly, developing energy-efficient display devices is an ongoing focus area for mobile personal computer manufacturers. For example, thin film transistor (TFT) liquid crystal display (LCD) devices have active pixel transistors that store charge at a switch rate proportional to the display refresh rate. In addition, a prior art graphics controller displays interface signals at a rate proportional to the display refresh rate. In other words, the operational rate of the prior art graphics controller may be varied with the display refresh rate of the display device. When the display refresh rate of the display device is predetermined, whether the graphics controller needs to output signals or not, the graphics controller has to work at the rate proportional to the predetermined display refresh rate. Therefore, even when there are identical display signals, the graphics controller has to work at a high rate, which results in low efficiency and high power-consumption.

An electronic apparatus, such as a laptop computer, usually uses a timing controller for receiving display and control signals from a graphics controller of the electronic apparatus, and converts the received signals into display signals for an associated LCD device.

Referring to PRIOR ART FIG. 1, a prior art timing controller 100 is illustrated. A Low Voltage Differential Signaling (LVDS) based Flat Panel Display (FPD) Link receiver 102 receives data signals and control signals. The received signals are a part of a parallel data stream which is routed to an 8-6 bit translator 104 for matching color depth. Through shifting the data length, the color depth is modified by the translator 104. The data path and timing REF 106 is coupled to the 8-6 bit translator 104 for separating the data signals to a serializer 108 and the control signals to a vertical and horizontal timing generation 112. The data signals are converted and serialized by the data path and timing REF 106 and serializer 108 into Reduced Swing Differential Signaling (RSDS) which needs timing adjustment, and outputted by the RSDS TX 110. The control signals generated by the vertical and horizontal timing generation 112 are sent to source drivers, gate drivers and power supply.

Another timing controller may combine frame memory for Response Time Compensation (RTC) in the prior art. The RTC feature is implemented by means of using a boost or overdrive voltage that forces the liquid crystal material to respond more rapidly. This boost or overdrive is accomplished by combination of an internal or external Electrically Erasable Programmable Read-Only Memory (EEPROM) Look up Table (LUT), which contains the boost/overdrive levels and external memory that acts as a frame buffer. The RTC improves the intra-gray level response time of the LCD panel. This design uses frame memory for RTC but not for power saving.

Typically, a graphics controller in the prior art converts a set of source images or surfaces, combines them and sends them out at the proper timing to an output interface connected to a display device. Along the way, the data can be converted from one format to another, stretched or shrunk, and color-corrected or gamma-converted.

The graphics controller comprises display engines, display planes, a display data channel, and so on. Display engines, comprise video engine, two-direction (2D) engine, and three-direction (3D) engine, which fetches display data from system memory. The display planes of the graphics controller comprise rectangular-shaped images that have characteristics including source, size, position, method, and format. These planes are associated with a particular destination pipe, and the pipe is associated with ports. The Display Data Channel (DDC) allows communication between the host system and display. Both configuration and control information can be exchanged allowing plug-and-play systems to be realized.

The display data of the graphics controller is converted into LVDS signals or signals which is serialized data received by a timing controller. The output signals comply with a standard established by the TIA/EIA (Telecommunications Industry Association/Electronic Industries Association) ANSI/TIA/EIA-644-A (LVDS), which are sent to a LCD device through a timing controller.

SUMMARY OF THE INVENTION

It is an object of the present invention to provide a device or method for driving a display device with low power consumption and electromagnetic interference (EMI).

In order to achieve the above object, the present invention provides a method for driving a display device which comprises processing a plurality of sequent frame data by a graphics controller. The graphics controller is capable of optimizing a frame rate and outputting a first plurality of display signals at the frame rate. And then, a timing controller is used to convert the first plurality of display signals into a second plurality of signals at a predetermined refresh rate.

BRIEF DESCRIPTION OF THE DRAWINGS

Other objects, advantages, and novel features of the invention will become more apparent from the following detailed description when taken in conjunction with the accompanying drawing.

PRIOR ART

DESCRIPTION OF EMBODIMENTS OF THE PRESENT INVENTION

Reference will now be made in detail to the embodiments of the present invention, method of driving a display device. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
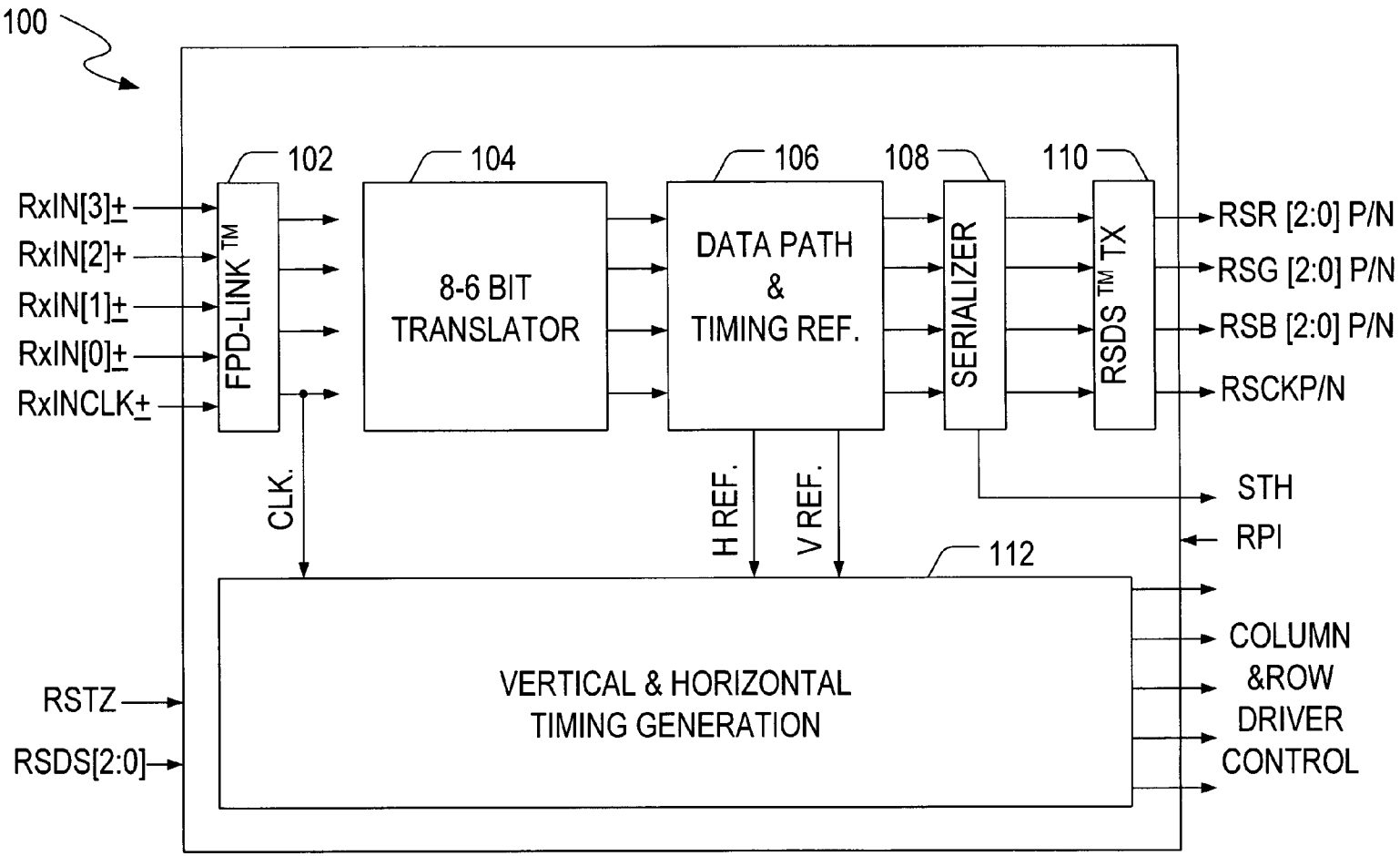
FIG. 1 (PRIOR ART)
FIG. 1 is a block diagram showing a timing controller in the prior art.
Figure 2:
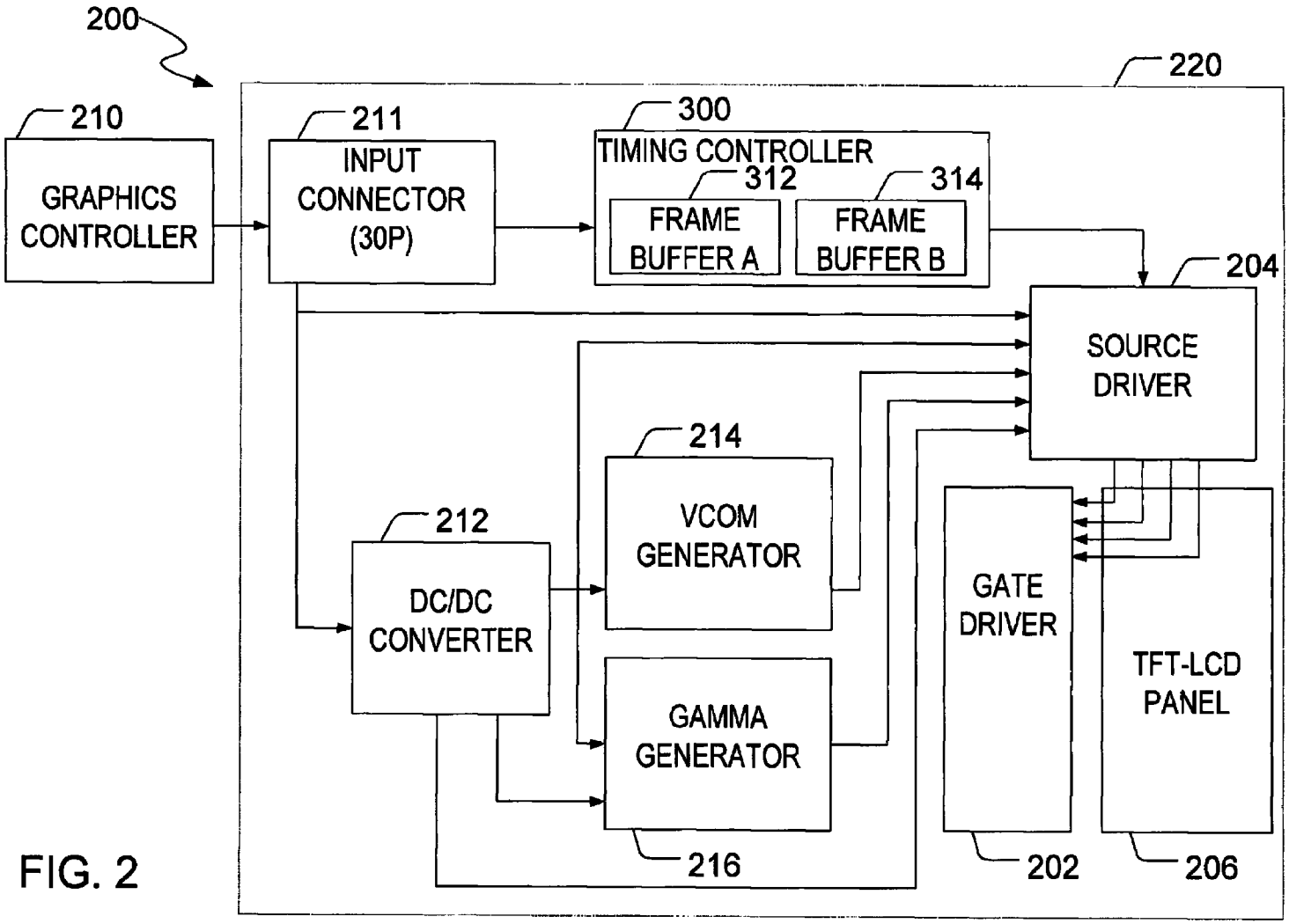
FIG. 2 is a block diagram showing a display system for an electronic apparatus in accordance with one embodiment of the present invention.

Referring to FIG. 2, a display system 200 of an electronic apparatus is illustrated, in accordance with one embodiment of the present invention. For example, the electronic apparatus can be any electronic apparatus, which has a display, such as a PDA, a desktop computer or a laptop computer. Hereinafter, a laptop computer would be taken as an example for description, and it will be apparent to those skilled in the art that the electronic apparatus is not limited to a laptop computer. The display system 200 includes a graphics controller 210 coupled to the electronic apparatus and a display module 220, such as a Thin-film Transistor (TFT) LCD module.

The graphics controller 210 is coupled to the display module 220 through an electrical signaling system, such as Low Voltage Differential Signaling (LVDS) signals. The LVDS signals are capable of running at high speeds over cables, such as twisted-pair copper cables resides on the main board of the laptop computer. The display module 220 comprises an input connector 211, DC/DC converter 212, Vcom generator 214, gamma generator 216, a timing controller 300, a gate driver 202, a source driver 204, and a TFT-LCD panel 206.

When the laptop computer is powered-on, the graphics controller 210 sends LVDS signals which comprise display data, control and clock signals to the display module 220. In one embodiment of the present invention, the graphics controller 210 can output LVDS signals with varied frame frequencies.

The input connector 211 supplies DC power. Through DC/DC converter 212, predetermined voltages of DC power are provided to the Vcom generator 214 and the gamma generator 216 for generating gate voltage, control voltage and other reference voltages to the source driver 204. In one embodiment, the input connector 211 and the DC/DC converter 212 provide −5V and 20V for the gate driver 202 through the source driver 204, which are gate voltages for TFT-LCD panel 206. Through the gamma generator 216 and Vcom generator 214, a reference voltage, such as 10V, is provided for adjusting the gray scale or the brightness of the TFT-LCD panel 206.

Figure 3:
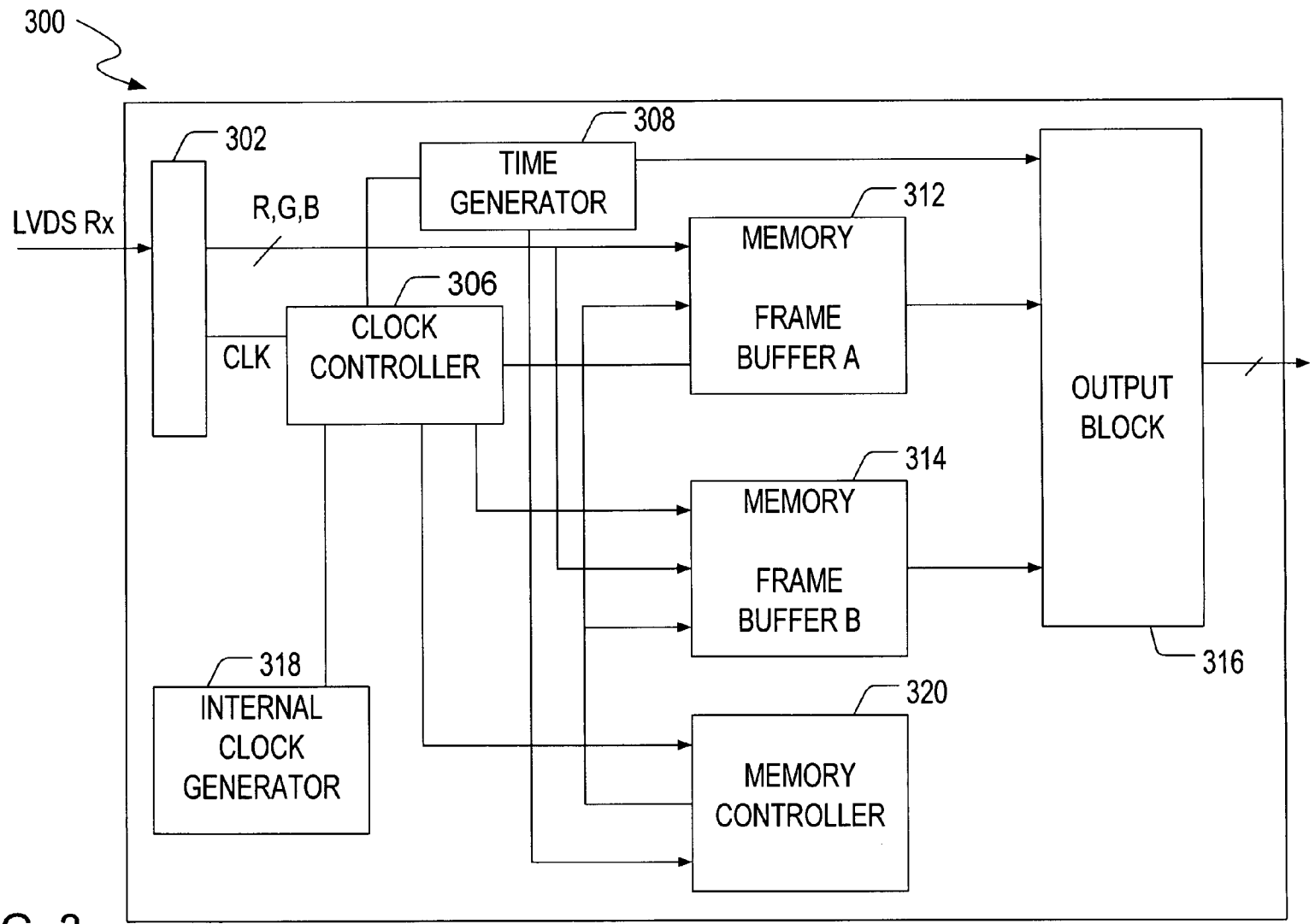
FIG. 3 is a block diagram showing a timing controller with frame buffers of the display system shown in FIG. 3, in accordance with one embodiment of the present invention.

The timing controller 300, which is also shown in FIG. 3 and described in detail hereinafter, is operated as an interface between the graphics controller 210 and driver Integrated Chips (ICs), such as the gate driver 202 and the source driver 204 of the display module 220 shown in FIG. 2. The timing controller 300 receives the LVDS signals from the graphics controller 210 and converts them to Transistor-Transistor Logic (TTL) data. The LVDS signals transmitted from the graphics controller 210 are de-serialized to parallel data which comprises red, green and blue pixel (RGB) data signals for color data, clock signals and control signals. Through the TTL data, the timing controller 300 generates control signals which are sent to the gate driver 202 and the source driver 204. In one embodiment, the timing controller 300 uses Reduced Swing Differential Signaling (RSDS) output interface. As such, the TTL data is converted to RSDS signals which are serial signals for the source driver 204 and the gate driver 202.

The gate driver 202 and the source driver 204 are used to drive the LCD panel 206. The LCD panel 206 comprises a plurality of gate lines for receiving the gate voltages from the gate driver 202 as scanning signals, and a plurality of source lines intersecting with the gate lines and receiving the data voltages from the source driver 204 as data signals. The source driver 204 stores the RGB data received from the timing controller 300 through RSDS signals, and receives an instruction signal for converting the digital data to analog signals. Upon receiving the instruction signal, the source driver 204 outputs an analog signal that corresponds to individual pixels of the LCD panel 206.

The gate driver 202 comprises a shift register, a level shifter and a buffer, which are not shown in FIG. 2. The gate driver 202 receives a gate clock signal and a vertical line start signal from the timing controller 300. Also, the gate driver 202 receives voltages from the common voltage (Vcom) generator 214 and outputs gate voltages to provide a path for applying the corresponding voltage values to the individual pixels on the LCD panel 206.

During displaying a dynamic image, frames will be established. Each of the frames comprises many scanning lines. After every scanning line of the frame is scanned, the next frame comes to the timing controller 300. In one embodiment, the TFT-LCD panel 206 is refreshed at the refresh rate of 60 Hz. In other words, the frames are refreshed at the frequency of 60 Hz. However, the timing controller 300 may receive display data at a frame rate lower than 60 Hz, such as 30 Hz or below, and then output data to the liquid crystal display panel at the refresh rate of 60 Hz.

In accordance with embodiments of the present invention, in order to reduce power consumption, it is not necessary that the frame rate of the graphics controller 210 be as high as the refresh rate of the LCD panel 206. In other words, the frame rate of the graphics controller 210 can be lower than the refresh rate of the LCD panel 206. As an interface between the graphics controller 210 and the LCD panel 206, the timing controller 300 can respond to the varied frame rate output from the graphics controller 210 and output the display signals at a predetermined refresh rate for the LCD panel 206 according to one embodiment of the present invention. The timing controller 300 includes a frame buffer A 312 and a frame buffer B 314 shown in FIG. 2. The data in one of the frame buffer A 312 and the frame buffer B 314 of the timing controller 300 can be repeatedly read so as to synchronize the other one of the frame buffer B 314 and the frame buffer A 312, which is described in more detail hereinafter.

Referring to FIG. 3, a timing controller 300 as shown in FIG. 2 with memory or frame buffers 312 and 314, in accordance with one embodiment of the present invention is illustrated. As mentioned above, the timing controller 300 installed in the display module 220 shown in FIG. 2 comprises an LVDS input interface with RSDS output interface, and further comprises memories, such as the frame buffer A 312 and the frame buffer B 314 embedded internally in the timing controller 300 in accordance with one embodiment of the present invention. In another embodiment of the present invention, the timing controller 300 comprises external frame buffers 312 and 314.

LVDS, in the industry, is a popular differential data transmission standard which is addressing the needs of today's high performance data transmission applications. Since the signal has improved noise immunity, voltage can be reduced and data rate can be increased. The LVDS receiver 302 according to one embodiment of the present invention receives de-serialized LVDS signals from the graphics controller 210 as mentioned above.

The timing generator 308 coupled to the LVDS receiver 302 combines signals from the LVDS receiver 302 and the clock controller 306 for generating control signals for source drivers, gate drivers and power supply. The internal clock generator 318 which is coupled to the clock controller 306 generates internal clocks for the timing controller 300. The memory controller 320 which is controlled by the clock controller 306 and the timing generator 308 assigns data for writing into or reading from the frame buffer A 312 and the frame buffer B 314.

The frame buffer A 312 and the frame buffer B 314 controlled by memory controller 320 receive data signals of LVDS signals from the LVDS receiver 302. In response to the input frame rate, the memory controller 320 controls the frame buffer A 312 and frame buffer B 314 to read or write alternately. When the frame rate received from the graphics controller through the LVDS receiver 302 is the same as the refresh rate for the LCD panel, the frame buffer A 312 and frame buffer B 314 are written and read with the same frequency. When the graphics controller 210 shown in FIG. 2 optimizes the frame rate to lower than the refresh rate, the frame buffer A 312 and the frame buffer B 314 can be read and written alternately at different frequency, which will be described in more detail hereinafter.

The output block 316, such as an RSDS output interface, converts data read from the frame buffer A 312 or the frame buffer B 314 to data in RSDS or mini LVDS format, or in another format. Through the output block 316, the timing controller 300 outputs the instruction signals to the source driver 204 and the gate driver 202 for driving the LCD panel 206 shown in FIG. 2.

RSDS interface is a differential signal protocol that is similar to LVDS except in their intended application. By using the RSDS interface, the computer system can benefit from the connection between the timing controller 300 and the source driver 204 with high speeds and low Electromagnetic Interference (EMI). Moreover, interconnect power consumption of the timing controller 300 and the source driver 204 can also be reduced.

Figure 4:
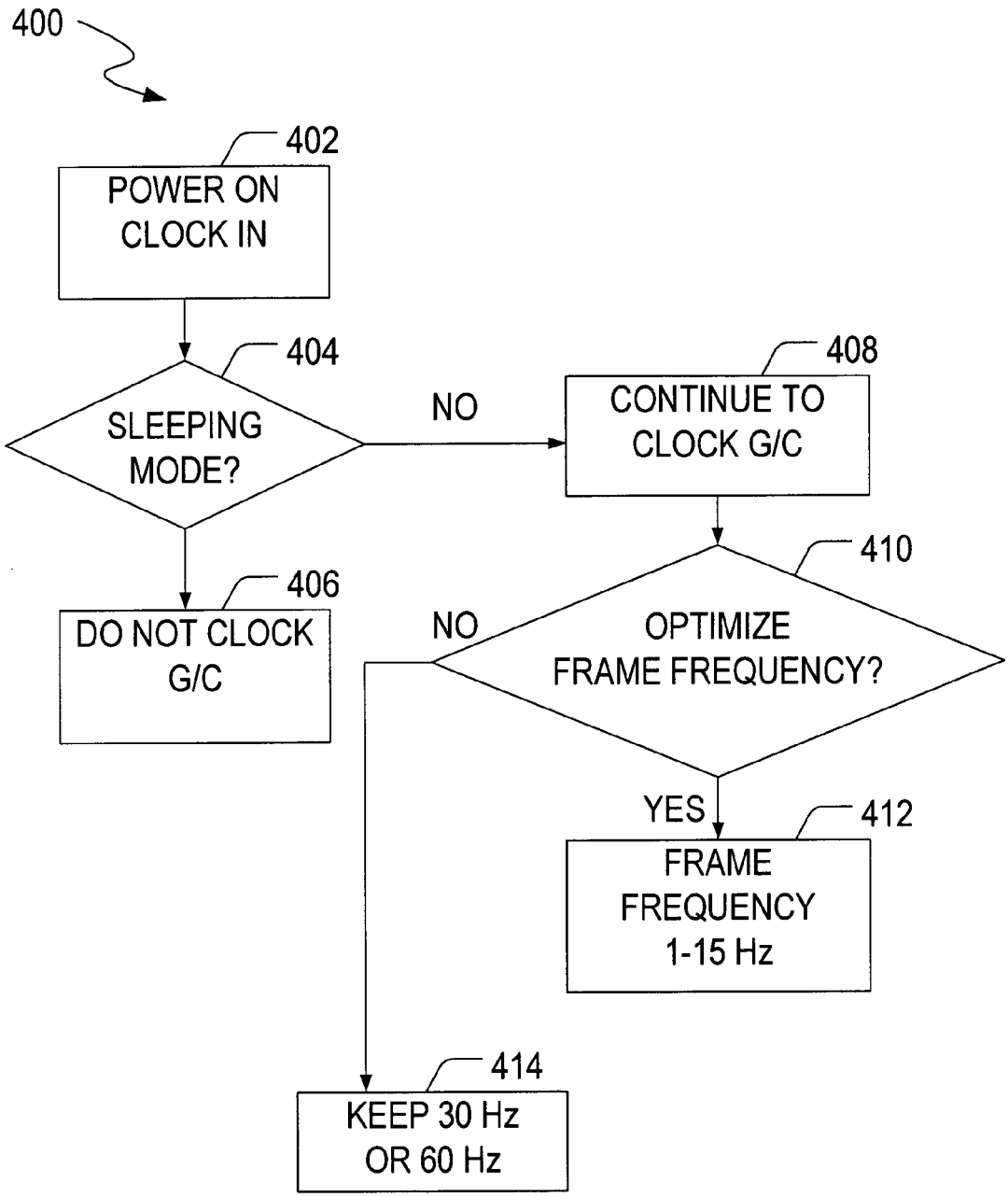
FIG. 4 is a flow chart showing the operation process of the graphics controller, in accordance with one embodiment of the present invention.

Referring to FIG. 4, a flow chart of the operation process of the graphics controller is illustrated, in accordance with one embodiment of the present invention. At 402, when a laptop computer with display system is turned on, the graphics controller receives a clock signal, which is controlled by Basic Input/Output System (BIOS) of the laptop computer. In one embodiment, the BIOS is special software stored on a memory chip on the main board for interfacing the major hardware components with the operating system.

At 404, the sleeping mode of the computer system is determined. If the computer system operates into a sleeping mode, then go to 406. A clock signal will not be sent to the graphics controller at 406. If not, then go to 408, and the clock signal is continued to be sent to the graphics controller.

At 410, the graphics controller compares the present frame data with the subsequent frame data for optimizing the frame rate, which will be described fully below with reference to FIG. 5. In one embodiment, if the present frame data is different from the subsequent frame data, then go to 414 and the output frequency keeps unchanged. At the 414, for example, the frequency of frame data is kept at 60 Hz or 30 Hz.

At 410, if the present frame data is the same as the subsequent frame data or the presentation on screen does not change, then go to 412. For example, when a user reads news, the display image on the screen may be kept identical and the present frame data and the subsequent frame data are the same. At 412, the graphics controller can optimize the frame rate. The frequency of the output data from the graphics controller is adjusted to be lower than that before in order to save power. As such, the power consumption can be reduced. In addition, since the frequency is reduced, EMI which happens when signal transition at high speed makes high emitting interference is reduced also.

Figure 5:
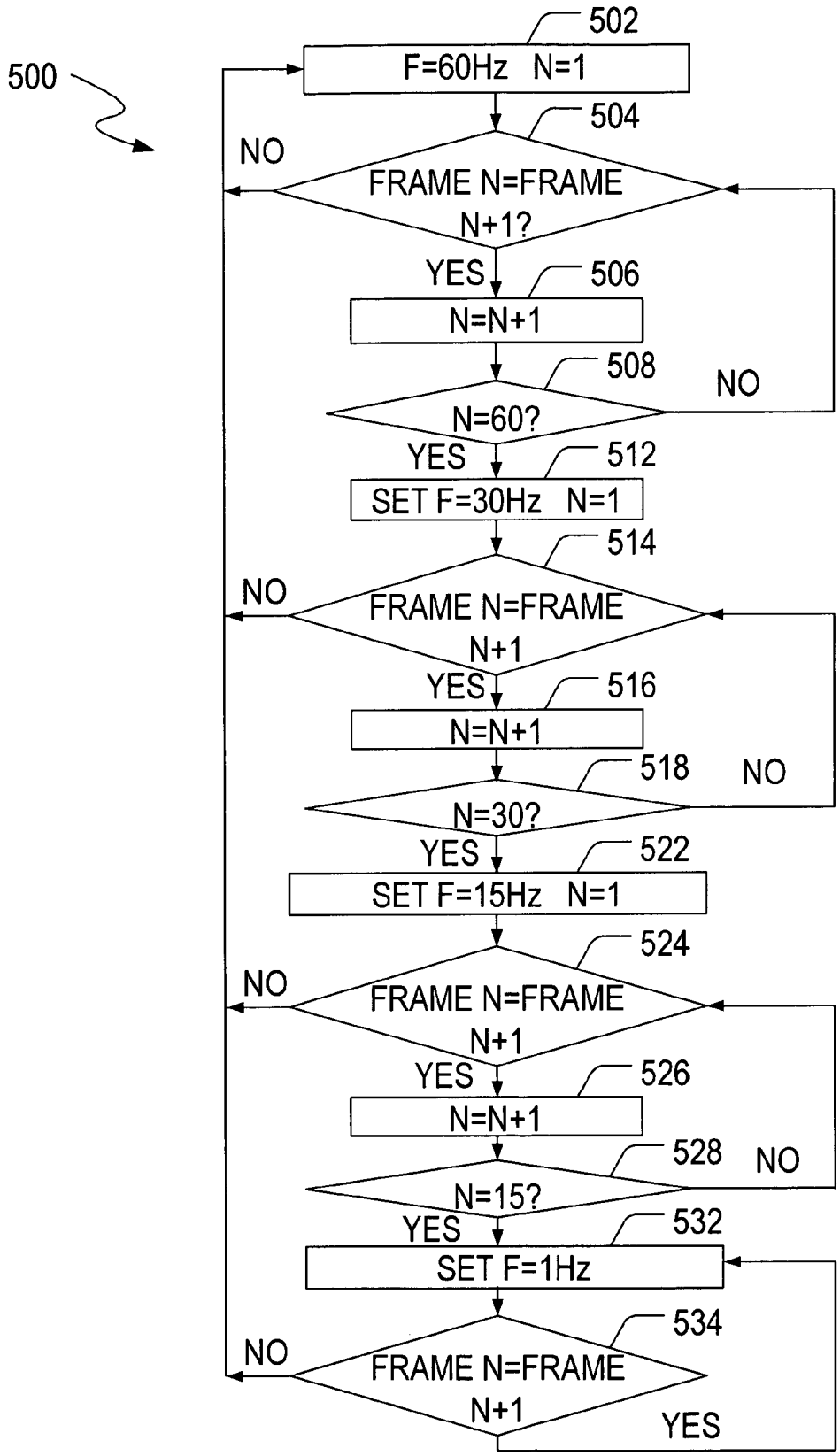
FIG. 5 is a flow chart showing a method for optimizing frame rate of the graphic controller according to one embodiment of the present invention.

Referring to FIG. 5, a method 500 of optimizing frame rate of the graphic controller is illustrated according to one embodiment of the present invention. In order to vary frame rate, the graphic controller is programmed and operated according to the method 500 shown in FIG. 5. The programming code of the method 500 can be a part of BIOS of the computer system. At 502, in one embodiment, at the beginning, the output frame rate is set as 60 Hz, and the value of an integer N is given by one. At 504, the present frame, the frame N, and the subsequent frame, the frame (N+1), are compared with each other. If the present frame and the frame (N+1) are the same, then go to 506; if not, then go back to 502. At the 506, the value of N is added by one, and then go to 508. At the 508, the integer N is checked to see if the integer is larger than 60. If the integer N is larger than 60, then go to 512 and otherwise go back to 504. In other words, during a certain period of time, every frame is compared with the subsequent frame. In one embodiment, when all frames during the period of time are the same, N is continually added until 60 at 508. At the 512, the frame rate is set as 30 Hz and N is set to be one. Once a different frame is involved, the frame rate is reset at 60 Hz and N is reset to be one. As such, a first circle for optimizing the frame rate from 60 Hz to 30 Hz is implemented.

A second circle for optimizing the frame rate from 30 Hz to 15 Hz is implemented at 502, 514, 516, 518 and 522, which is similar to the first circle. For clarity, the 502, 514, 516, 518 and 522 will not be described in detail. However, since the frequency is reduced to 30 Hz, the integer N is checked to see if the integer is larger than 30 at the 518.

A third circle for optimizing the frame rate from 15 Hz to 1 Hz is implemented at 502, 524, 526, 528 and 532, which is similar to the first and the second circles. For clarity, the 502, 524, 526, 528 and 532 will not be described in detail. However, since the frequency is reduced to 15 Hz, the integer N is checked to see if the integer is larger than 15 at the 528.

When the frame rate is set to be 1 Hz at 532, the frame N and the frame (N+1) are compared with each other at 534. If they are the same, the frame rate is fixed to be 1 Hz; and if not, go to the 502. At the 502, the frame rate is reset at 60 Hz and the integer N is reset to be one.

Figure 6:
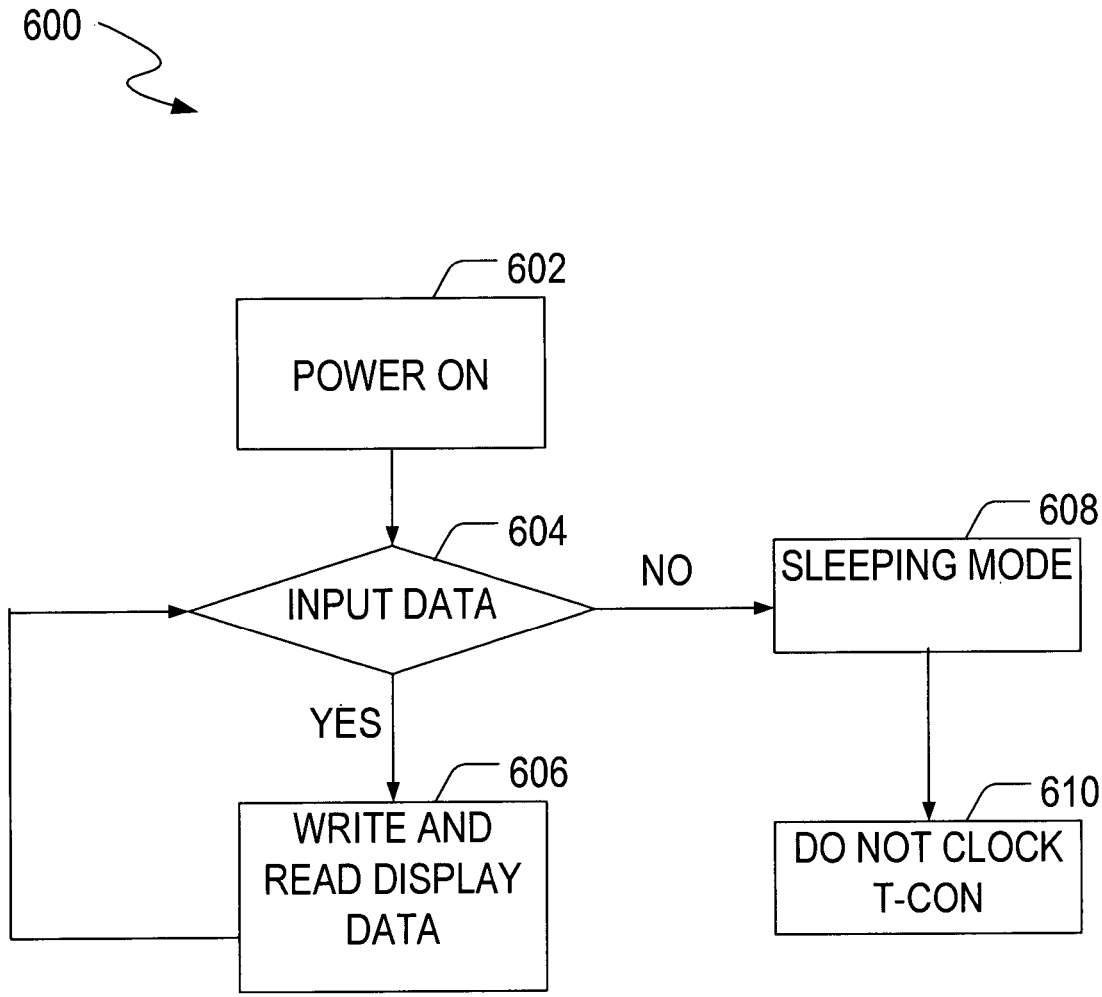
FIG. 6 is a flow chart showing the general operation process of the timing controller, in accordance with one embodiment of the present invention.

Referring to FIG. 6, an operation process of a timing controller is illustrated, in accordance with one embodiment of the present invention. The operation process of the timing controller will be described with reference to the time controller 300 shown in FIG. 3. At 602, when a computer system as well as a display system is turned on, the timing controller receives a clock signal, which is controlled by BIOS of the computer system.

At 604, the timing controller determines whether the input data is received. If the timing controller receives the input data from the graphics controller, then go to 606. At the 606, the received input data is alternately written into or read from the frame buffers A or B , which is described in more detail hereinafter with reference to FIG. 7 and FIG. 8. On the contrary, at the 604, if the timing controller recognizes that during one clock period, there is no data sent from the graphics controller, then go to 608. At 608, the timing controller operates in sleeping mode. In case the frame rate is lower than the refresh rate of the timing controller the timing controller needs to verify sleeping mode of the computer system. There is a time delay between the computer system and the timing controller in determining sleeping mode. For example, if the frame rate is 1 Hz and the refresh rate is 60 Hz, the timing controller waits for 60 cycles and then follows the sleeping mode after the computer system goes to the sleeping mode. At 610, when the timing controller works in the sleeping mode, the clock signal of the computer system is not sent to the timing controller.

Figure 7:
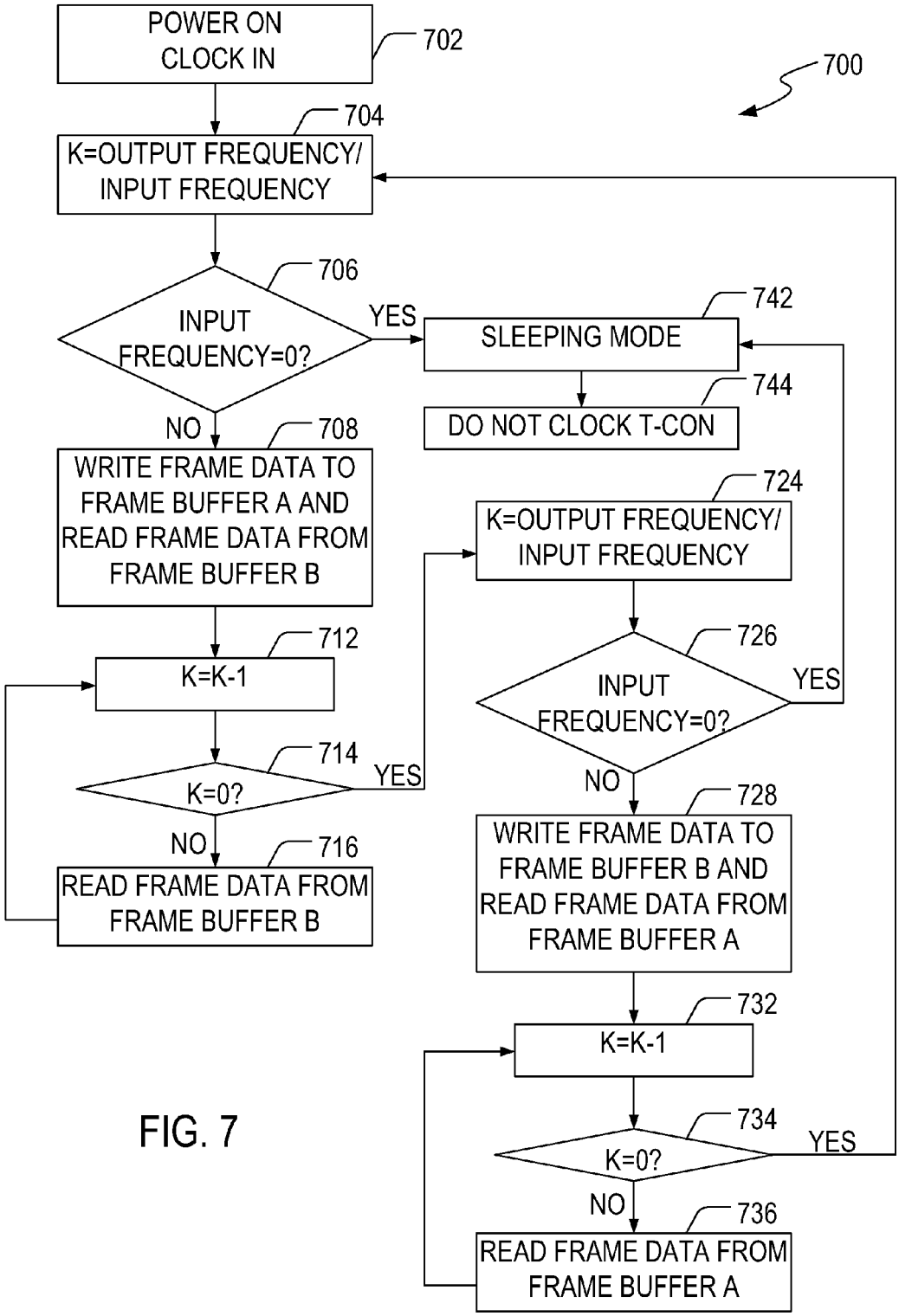
FIG. 7 is a flow chart showing the process for alternately writing and reading display data of the frame buffers of the timing controller operating at a frequency, in accordance with one embodiment of the present invention.

Referring to FIG. 7, a process for alternately writing and reading display data of the frame buffers A and B of the timing controller according to one embodiment of the present invention is illustrated. At 702, when the computer system as well as the display system is turned on, the timing controller receives a clock signal from a graphics controller of the computer system. At 704, the ratio of output frequency to input frequency of the timing controller 300 is designated as K. At 706, whether the value of the input frequency is zero or not is determined. If the input frequency is zero, the timing controller operates in sleeping mode at 742, when the clock signal of the computer system is not sent to the timing controller at 744. If not, then go to 708. At 708, the display data is written into the frame buffer A and read from the frame buffer B. And then, at 712, one is subtracted from K, and the new value is given to K. At 714, the value of K is checked to see whether the value of K is zero. When K is not zero, the display data is read from the frame buffer B at 716. And then, go back to 712. During a first cycle, the display data is written into the frame buffer A once and the output data keeps being read from the frame buffer B until the value of K is zero at 714, according to the 704, 706, 708, 712, 714 and 716. For the timing controller, the input frequency is the frame rate transmitted from the graphics controller, and the output frequency is the refresh rate for the LCD panel. The graphics controller can optimize the frame rate for saving power consumption as mentioned above. In this circumstance, the refresh rate is usually higher than the frame rate. As such, the frequency of reading the display data from the frame buffer is higher than that of writing the display data into the frame buffer A. With different input frame frequency, the frame buffer A and frame buffer B are written and read alternately which are illustrated with examples in relation to FIG. 8.

Referring back now to the FIG. 7, at 714, if K is zero, then go to 724 and the first cycle of writing data to the frame buffer A and reading data from the frame buffer B is ended. At 724, N is renewed by the ratio of the output frequency to the input frequency of the timing controller. A second cycle, which is similar to the first cycle, begins except that the display data is written into the frame buffer B once and the output data keeps being read from the frame buffer A. For clarity, the processes of 726, 728, 732, 734 and 736 will not be described in detail hereinafter. At 732, if the value of K is zero, the second cycle of writing data to the frame buffer B and reading data from the frame buffer A is ended and go to the 704 to start the first cycle. As such, the display data and the output data are written from and read into the frame buffers A and B alternately.

Figure 8:
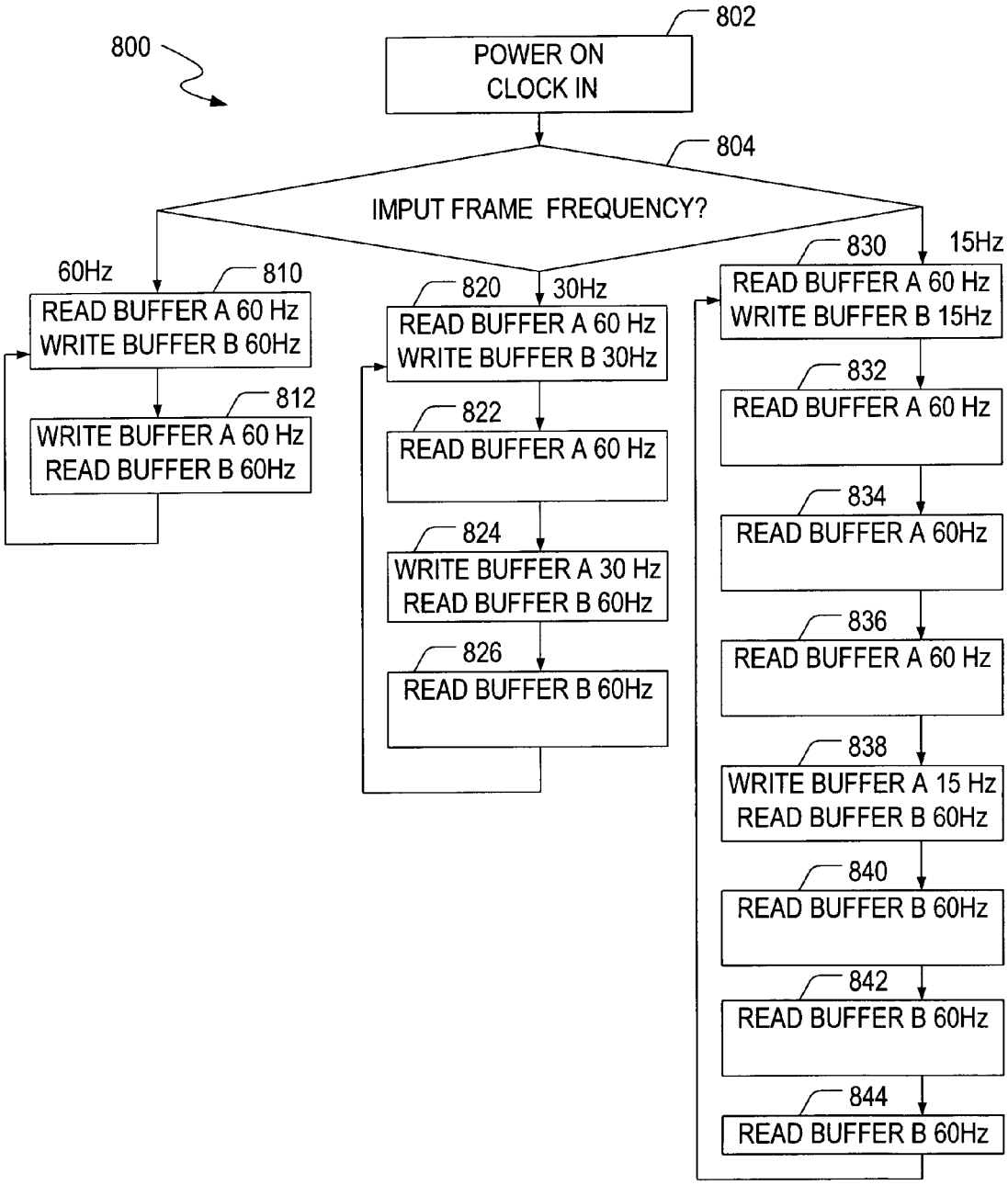
FIG. 8 is a flow chart showing the process of the timing controller operating with different input frame rates, in accordance with one embodiment of the present invention.

Referring to FIG. 8, a process of the timing controller operating with different input frequencies, in accordance with one embodiment of the present invention, is illustrated. At 802, when the computer system as well as the display system 400 is turned on, the timing controller receives clock signal. At 804, the input frequency is detected by the timing controller.

In one embodiment, at the 804, when the frame rate of the input data and the refresh rate of the output data are both 60 Hz, an output block of the timing controller reads the first frame data from the frame buffer A, and the second frame data is written into the frame buffer B. And then, at 812, the output block reads the second frame data from the frame buffer B, and the third frame data is written into the frame buffer A. Repeatedly, the frame data are written into the frame buffer A and frame buffer B alternately, and are read from the frame buffer B and frame buffer A alternately. As such, the frame data is sent to display device at the predetermined refresh rate, e.g. 60 Hz.

In another embodiment, when the frame rate of the input data and the refresh rate of the output data are 30 Hz and 60 Hz, respectively, the output block of the timing controller reads the first frame data from the frame buffer A twice at 802 and 822, and the second frame data is written into the frame buffer B once at 820. And then, at 824 and 826 the output block read the second frame data from frame buffer B twice, and the third frame data is written into the frame buffer once at 824. As such, the frame data is sent to the display device at the predetermined refresh rate, e.g. 60 Hz, although the input data is received at 30 Hz (the frame rate is 30 Hz).

In another embodiment, when the frame rate of the input data and the refresh rate of the output data are 15 Hz and 60 Hz, respectively, the output block of the timing controller reads the first frame data from the frame buffer A four times at 830, 832, 834 and 836, and the second frame data is written into the frame buffer B once at 830. And then, the output block reads the second frame data from frame buffer B for four times at 838, 840, 842 and 844, and the third frame data is written into the frame buffer A once at 838. As such, the frame data is sent to the display device at the predetermined refresh rate, e.g. 60 Hz, although the input data is received by the timing controller with 15 Hz.

In other embodiments of the present invention, any frame rate lower than 60 Hz may be used in place of 60 Hz, 30 Hz or 15 Hz as indicated hereinabove. And in these circumstances, the process 500 of the graphics controller shown in FIG. 5, and processed 700 and 800 of the timing controller, shown in FIG. 7 and FIG. 8, can equally be applied to reduce the power consumption.

While the foregoing description and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A method for driving a display panel comprising:

accessing display data comprising frames of dynamic images;

processing said display data to provide a first plurality of display signals in which said frames are refreshed at a frame rate;

converting said first plurality of display signals into a second plurality of display signals in which said frames are refreshed at a refresh rate;

adjusting said frame rate and maintaining said refresh rate according to contents of said frames; and refreshing said display panel at said refresh rate according to said second plurality of display signals.

2. The method as claimed in claim 1, further comprising:

accessing a present frame and a subsequent frame from said display data;

comparing said present frame with said subsequent frame; and maintaining said frame rate when said present frame is different from said subsequent frame.

3. The method as claimed in claim 1, further comprising:

accessing a present frame and a subsequent frame from said first plurality of signals;

comparing said present frame with said subsequent frame; and reducing said frame rate when said present frame is the same as said subsequent frame.

4. The method as claimed in claim 1, further comprising:

operating in a sleeping mode when said display data is not received.

5. The method as claimed in claim 1, wherein said converting further comprises:

writing said first plurality of display signals into a first frame buffer and a second frame buffer alternately at said frame rate; and reading said first and second frame buffers alternately at said refresh rate to provide said second plurality of display signals.

6. The method as claimed in claim 5, wherein said detecting further comprises:

calculating a ratio K of said refresh rate to said frame rate.

7. The method as claimed in claim 6, wherein said writing and reading further comprises:

reading said first frame buffer a number of times and writing said first plurality of signals into said second frame buffer once; and reading said second frame buffer the same said number of times and writing said first frame buffer once.

8. The method as claimed in claim 1, wherein said first plurality of display signals include a plurality of Low Voltage Differential Signaling (LVDS) signals.

9. The method as claimed in claim 1, wherein said second plurality of display signals include a plurality of Reduced Swing Differential Signaling (RSDS) signals.

10. A method for driving a display panel, said method comprising:

receiving a first plurality of display signals in which frames of dynamic images are refreshed at a frame rate;

writing said first plurality of signals into a first frame buffer and a second frame buffer alternately at said frame rate;

reading said first and second frame buffers alternately at a refresh rate to provide a second plurality of display signals;

adjusting said frame rate and maintains said refresh rate according to contents of said frames; and refreshing said display panel at said refresh rate according to said second plurality of display signals.

11. The method as claimed in claim 10, wherein said writing further comprises:

calculating a ratio K of said frame rate to said refresh rate;

reading said first frame buffer a number of times and writing said second frame buffer once; and reading said second frame buffer the same said number of times and writing said first frame buffer once.

12. The method as claimed in claim 10, further comprising:

operating in a sleeping mode when said first plurality of signals are not received.

13. A display system comprising:

a graphics controller operable for receiving display data comprising a plurality of frames of dynamic images, and for providing a first plurality of display signals in which said frames are refreshed at a frame rate according to said display data, and for adjusting said frame rate according to contents of said frames; and a display module coupled to said graphics controller and operable for converting said first plurality of display signals to a second plurality of display signals in which said frames are refreshed at a refresh rate, for maintaining said refresh rate when said frame rate varies, and for refreshing a display panel at said refresh rate according to said second plurality of display signals.

14. The display system as claimed in claim 10, wherein said display module comprises:

a pair of frame buffers for storing information about said frames; and a memory controller coupled to said frame buffers and operable for updating said information by writing said first plurality of display signals to said frame buffers at said frame rate and for generating said second plurality of display signals by reading said frame buffers at said refresh rate.

15. The display system as claimed in claim 14, wherein said memory controller is further operable for calculating a ratio K of said frame rate to said refresh rate, for reading a first frame buffer of said frame buffers a number of times and writing a second frame buffer of said frame buffers once, and for reading said second frame buffer the same said number of times and writing said first frame buffer once.

16. The display system as claimed in claim 10, wherein said first plurality of display signals include LVDS signals.

17. The display system as claimed in claim 10, wherein said second plurality of display signals include RSDS signals.

18. The display system as claimed in claim 10, wherein said second plurality of display signals include mini-LVDS signals.

* * * * *